US006341423B1

(12) United States Patent
Taggart et al.

(10) Patent No.: US 6,341,423 B1
(45) Date of Patent: Jan. 29, 2002

(54) MULTIPLE PURPOSE AUTOMOBILE TOOL

(75) Inventors: John Merrick Taggart, Cromwell; A. Jeffrey Turner, Madison; Edward S. Richardson, Fairfield, all of CT (US); Daniel J. Nelson, Providence, RI (US); Stephen E. Lanc, Jamestown, RI (US); Marc S. Harrison, deceased, late of Portsmouth, RI (US), by Diana R. Harrison, legal representative; Michael C. Pereira, Lincoln, RI (US); Aldan J. Petrie, Providence, RI (US)

(73) Assignee: Swiss Army Brands, Inc., Shelton, CT (US)

( * ) Notice: Subject to any disclaimer, the term of this patent is extended or adjusted under 35 U.S.C. 154(b) by 0 days.

(21) Appl. No.: 09/338,932

(22) Filed: Jun. 23, 1999

Related U.S. Application Data

(60) Provisional application No. 60/090,351, filed on Jun. 23, 1998.

(51) Int. Cl.[7] ..... B26B 3/00; B25B 7/22

(52) U.S. Cl. ..... 30/169; 30/143; 30/161; 81/440; 7/168; 7/163; 7/164; 7/128; 7/129; 7/119

(58) Field of Search ..... 7/127–129, 118–119, 7/132, 158, 163–165, 167–168; 81/427.5, 440, 177.4; 30/169, 57, 143, 151, 155, 161, 330

(56) References Cited

U.S. PATENT DOCUMENTS

| | | | | |
|---|---|---|---|---|
| 716,623 | A | * | 12/1902 | Brouillette |
| 1,407,652 | A | * | 2/1922 | Hallverson |
| 1,485,450 | A | * | 3/1924 | Baum |
| 1,728,992 | A | * | 9/1929 | Frank |
| 3,852,839 | A | * | 12/1974 | Blessing |
| 4,238,862 | A | | 12/1980 | Leatherman |
| 4,744,272 | A | | 5/1988 | Leatherman |
| 4,805,303 | A | | 2/1989 | Gibbs |
| 4,854,045 | A | | 8/1989 | Schaub |
| 4,888,869 | A | | 12/1989 | Leatherman |
| 4,918,775 | A | | 4/1990 | Leu |
| 5,062,173 | A | | 11/1991 | Collins et al. |
| 5,142,721 | A | | 9/1992 | Sessions et al. |
| D336,415 | S | | 6/1993 | Cheng |
| 5,251,351 | A | | 10/1993 | Klotz |
| 5,267,366 | A | | 12/1993 | Frazer |
| 5,313,376 | A | | 5/1994 | McIntosh |
| D368,634 | S | | 4/1996 | Frazer |
| D371,498 | S | | 7/1996 | Lai |
| D382,182 | S | | 8/1997 | Seber et al. |
| 5,664,274 | A | | 9/1997 | Collins |
| D385,168 | S | | 10/1997 | Rivera |
| 5,689,886 | A | | 11/1997 | Yeh |
| 5,692,304 | A | * | 12/1997 | Campbell |
| 5,697,114 | A | | 12/1997 | McIntosh et al. |
| 5,809,599 | A | * | 9/1998 | Frazer |
| 5,916,277 | A | * | 6/1999 | Dallas |

* cited by examiner

*Primary Examiner*—D. S. Meislin
(74) *Attorney, Agent, or Firm*—Pennie & Edmonds LLP

(57) ABSTRACT

A multi-purpose tool including a plurality of tools useful to have available in an automobile, such as a flashlight, a tire pressure gauge, a scraper, and a fuse puller. The scraper preferably is pivotably mounted to a handle of the multi-purpose tool in a manner which permits the scraper to be positioned substantially perpendicular to the tool handles to permit scraping force to be applied to the scraper in an efficient manner. The multi-purpose tool preferably also includes a tool with pivotable jaws, such as a pair of foldable pliers, as well as a variety of pivotably mounted tools such as a cutting blade, a screwdriver, and a cap lifter. The tool preferably has two handles, each handle having storage channels for the tools coupled thereto. The tool jaws are pivotably mounted to the handles for selective movement between a storage position in the handles and a working position in which the jaws work together. Preferably, when the jaws are in a working position, the other tools coupled to the handles are in a storage channel facing another handle so that the exterior of the handles in this configuration of the multi-purpose tool is substantially smooth without tools positioned along the gripping surface, thereby increasing user comfort during use of the jawed tool.

30 Claims, 14 Drawing Sheets

MULTIPLE PURPOSE AUTOMOBILE TOOL

CROSS-REFERENCE TO RELATED APPLICATION

This application claims priority of U.S. provisional patent application Ser. No. 60/090,351, filed Jun. 23, 1998, which application is hereby incorporated by reference in its entirety.

BACKGROUND OF THE INVENTION

1. Technical Field of the Invention

The present invention relates to multiple purpose tools. More particularly, the invention relates to a multiple purpose tool having tools useful to have available in an automobile.

2. Description of Related Art

Multiple purpose ("multi-purpose"), compact tools providing a variety of other tools, such as a tool with moveable jaws as well as pivotably mounted tools which may be pivoted into and out of a channel within the handle of the tool for selective use are known in the art. However, the known multi-purpose tools typically do not contain those tools which are commonly useful to have available in an automobile, and do not contain tools specific to automobiles. Moreover, such multi-purpose tools do not include an efficient scraper tool which can be selectively retracted into a handle and extended into an appropriate orientation for effective use, such as with the scraping edge perpendicular to the longitudinal, major axes of the tool handles. While foldable tools, such as knives, can conceivably be used for scraping purposes (such as scraping ice from a windshield), the blade of these tools generally extend from the pivot point along the longitudinal, major axis of the tool handle, rather than perpendicular to the handle, as in conventional scrapers with fixed scraping blades. This orientation results in an inefficient application of scraping force to the scraping edge. Further, since the back of the scraper is supported only by the user's hand, the majority of the exerted force is applied through the pivot point, increasing the risk of tool breakage and user injury.

Compound, multi-purpose tools having foldable handles and at least one tool with moveable jaws, such as pliers, foldable into the handles typically have handles with a U-shaped channel into which the remaining pivotably tools may be stored. For example, U.S. Pat. No. 4,238,862, entitled "Pocket Multiple Tool", discloses foldable pliers with each handle having a single U-shaped channel that houses the plier jaws and several other pivoting tools. The channels are arranged to face inward when the pliers are closed so that they surround the jaws. However, this arrangement prevents use of the pivoting tools when the pliers are folded. Further, access to a tool other than the pliers requires more than the single step of extending the desired tool, since the pliers must also be unfolded.

Reversing the direction of the channel on the handles allows the pivoting tools to be used without opening the pliers members. However, the structural integrity of the U-channel must be compromised to accommodate the plier jaws when the tool is folded. For example, U.S. Pat. No. 5,697,114, entitled "Folding Multi-Tool", discloses folding pliers with U-channels in the handles configured to open outward when the pliers are folded. As shown in FIGS. 4 and 5 of that patent, a hole must be cut through the bottom wall of the channel to accommodate the folded plier jaws. The hole not only makes the handle less comfortable to grasp when using the pliers, but also may reduce the structural integrity and strength of the handle. The hole further exposes the pivoting tools stored in the channel, including the cutting surface of knife blades, and thus increases the risk of injury when the pliers are used.

SUMMARY OF THE INVENTION

In accordance with the principles of the present invention a compact, foldable, multiple purpose ("multi-purpose") tool is provided with a plurality of tools for use in or with an automobile. Preferably, the multi-purpose tool includes jaw members retractable into a first storage area of the handles and a plurality of different tools positioned in a second storage area of the foldable handles and accessible when the jaws are retracted.

The jaw members preferably have a jaw pivot axis and tangs extending from the jaw pivot axis away from the jaw members. Preferably, the handles are pivotable along an axis through the tangs substantially parallel to the jaw pivot axis. The jaw members are stored within first channels in the handles, the outside surfaces of the jaw members being nested within the channels. The jaw members together form a jawed tool, such as pliers or scissors.

A second channel is provided in each handle of the tool opposite the first channel in which the jaw members are stored. In one embodiment, the first and second channels are side by side such that the channels have an S-shaped cross-section in a region of the handles where the first and second channels are coextensive. A variety of other tools useful to have available in an automobile may be stored within the second channels in the handles. The other tools are accessible for use when the jaw members are in their retracted, stored position. Thus, the handles may be in a folded position when these other tools are used, so that the handles, together, form a single handle for these other tools. When the multi-purpose tool is unfolded to use the jawed tool, the second channels cover the other tools to provide a safe and comfortable gripping surface for the handles of the jawed tool.

At least some of the additional tools are pivotable along a pivot axis substantially parallel to the pivot axis of the jaw members and the tangs. The pivoting tools may be connected either to an end of a handle adjacent the connection point of the jaw members, on an axis separate from or combined with a pivot axis of a jaw member, or to an end of the handles opposite the connection point of the jaw members. Other tools may be fixedly mounted to a handle.

The multi-purpose tool of the present invention preferably include at least one of the following tools: a scraper, a Phillips head screwdriver, a flathead screwdriver, a flashlight, a cutting blade, a tire pressure gauge, and a fuse puller. Any or all of such tools may be pivotably coupled to a handle of the multi-purpose tool of the present inventions for selective retraction into the second channel of the handle for storage or extraction to a working position. Others of such tools may be fixedly coupled to one of the handles of the multi-purpose tool.

Preferably a scraper is pivotably mounted to one of the handles to permit the scraper to pivot out of the second channel of the handle in excess of 180° to a working position in which the scraping edge is substantially perpendicular to the major, or longitudinal axes of the handles at an end of the handles. Such orientation of the scraper with respect to the handles allows force to be applied to the scraper along the longitudinal axes of the handles, normal to the scraping edge, thus improving both efficiency and safety.

Preferably, a locking mechanism is associated with the pivotably mounted tools to lock the tools either into the retracted storage position or in an extended working position so that the tool does not accidentally retract into its storage channel during use. A locking mechanism may be provided for each pivotably mounted tool for either or both such locking functions. Most preferably, each tool has its own locking mechanism for at least one locking function.

These and other features and advantages of the present invention will be readily apparent from the following detailed description of the invention, taken in conjunction with the accompanying drawings which illustrate, by way of example, features of the present invention.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENT(S)

Figure 1:
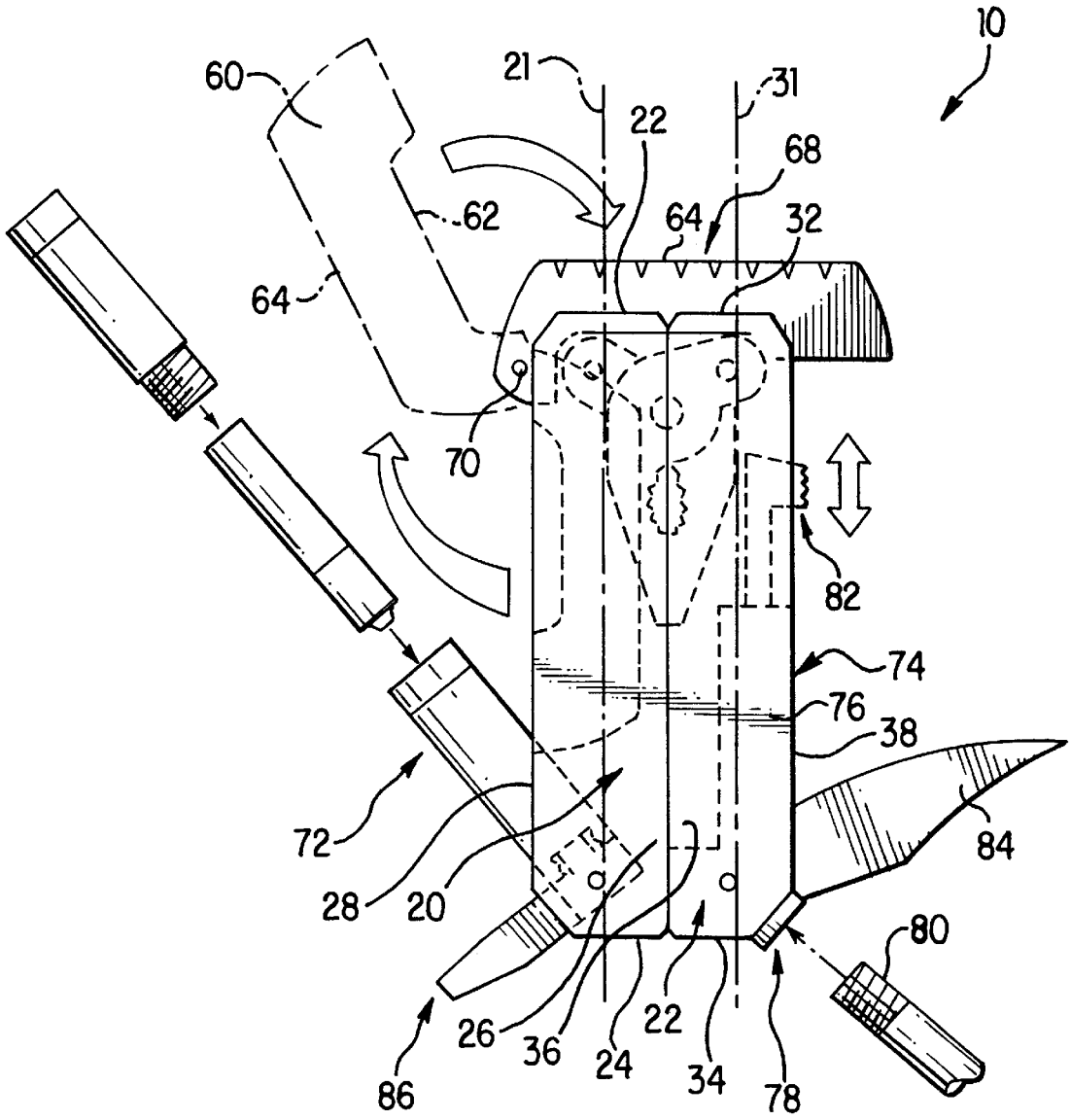
FIG. 1 is a front elevational view, with certain hidden elements being illustrated in broken lines, of a first embodiment of a multi-purpose tool formed in accordance with the principles of the present invention and in a folded configuration.
Figure 2:
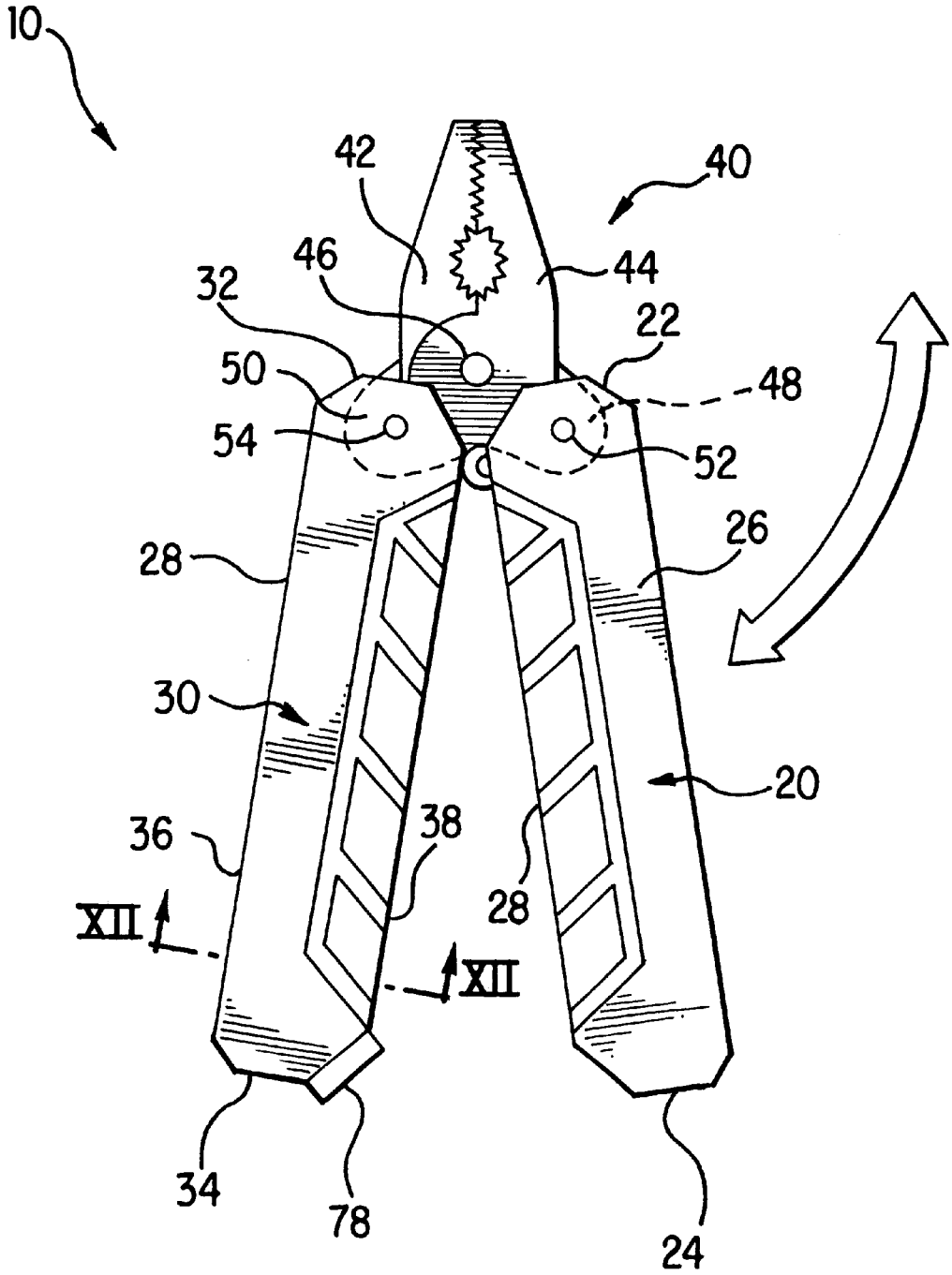
FIG. 2 is a front elevational view of the multi-purpose tool of FIG. 1 shown in an unfolded position.

Referring now to FIGS. 1 and 2, a multi-purpose tool 10, formed in accordance with the principles of the present invention, is illustrated. Multi-purpose tool 10 has a first handle 20 and a second handle 30 to which a variety of tools may be coupled. The specific arrangement of various tools within the handles 20, 22 of the multi-purpose tool 10 will be discussed in detail below with reference to FIGS. 2–11. First handle 20 has a top end 22, a bottom end 24, a front side 26, and a rear side 28. First longitudinal axis 21 extends between top and bottom ends 22, 24 of first handle 20. Similarly, second handle 30 has a top end 32, bottom end 34, a front side 36, and a rear side 38, with a longitudinal axis 31 extending between top and bottom ends 32, 34.

Multi-purpose tool 10 preferably includes a tool head 40 with a pair of jaw members pivotably coupled for opposed movement, such as a set of pliers. Jaw members 42 and 44 of tool head 40 are preferably pivotably coupled along jaw pivot axis 46. Jaw members 42, 44 preferably are pivotably coupled to respective first and second handles 20, 22 via respective tangs 48, 50 at tang pivot axes 52, 54, respectively. Preferably, tool head 40 is coupled to top ends 22, 32 of handles 20, 30, and tang pivot axes 52, 54 are substantially parallel to pivot axis 46. In a folded configuration, illustrated in FIG. 1, tool head 40 fits into the first and second handles 20, 30 in a manner discussed below. In an unfolded configuration, illustrated in FIG. 2, the handles 20, 30 may be used to apply force to jaws 42 and 44.

A scraper tool 60 preferably is also incorporated into multi-purpose tool 10. Most preferably, scraper 60 is pivotably coupled to one of handles 20, 30 for pivoting between a retracted storage position and an extended working position. As shown in the embodiment of FIG. 1, scraper 60 of tool 10 is coupled to first handle 20 for extending into a working position adjacent top end 22. Scraper 60 has an access edge 62 and a scraping edge 64. Scraper 60 may be retracted into a storage position within a handle, such as first handle 20 of multi-purpose tool 10, such that access edge 62 is accessible when tool 10 is in a folded configuration, as shown in FIG. 1. Scraper 60 can be pivoted about pivot axis 70, preferably through an arc of greater than 180°, and most preferably substantially 270°, to a working position, as illustrated in solid lines in FIG. 1.

In accordance with the principles of the present invention, force can be applied to scraper 60 along longitudinal axes 21, 31 of handles 20, 30 when scraper 60 is in a working position. The arrangement of scraper 60 with respect to handles 20, 30 as shown in FIG. 1 permits a substantial portion of the applied force to be normal to scraping edge 64, thereby increasing the efficiency of scraper 60 in comparison with conventional folding tools which extend along the longitudinal axes of the tool handles, and thus require force to be applied through the pivot point about which the scraper is coupled to the handle. Further, because force is applied to scraper 60 of the present convention primarily through handles 20, 30 along access edge 62, and not through pivot axis 70, pivot axis 70 does not need to be designed to withstand a great deal of force. This not only increases the life of the tool, but also permits the pivot connection between scraper 60 and first handle 20 to be designed with less mechanical strength. Therefore, the pivot connection for scraper 60 may be manufactured less expensively and lighter, as compared with other pivot connections such as pivot axes 48, 50 for tool head 40.

In accordance with the principles of the present invention, other tools which would be useful to have available in an automobile are also coupled to the handles 20, 30. For example, as shown in FIG. 1, a flashlight 72 is mounted, such as pivotably, near bottom end 24 of first handle 20. Additionally, a pressure gauge 74 may be coupled to one of handles 20, 30 as well. As shown in FIG. 1, pressure gauge 74 may be mounted within second handle 30, opposite flashlight 72 in first handle 20. Pressure gauge 74 includes a body portion 76 housed near bottom end 34 of handle 30 with a valve attachment 78 for receiving a tire valve 80. The measured tire pressure is indicated along handle 30. For example, a sliding gauge portion 82 may extend from body portion 76 towards top end 32 of second handle 30. A pressure scale may be inscribed on sliding gauge portion 82 itself or on handle 30 adjacent pressure gauge 74. Other pressure indicators, such as digital indicators, may be used instead.

Other tools, such as a blade 84 and a screwdriver 86, may also be pivotably mounted within handles 20, 30, as illustrated. Such tools preferably are those typically useful in association with an automobile.

It will be appreciated that tool storage chambers are provided in handles 20, 30 in any desired configuration permitting retraction of a tool therein. For example, the internal configuration of handles 20, 30 and the arrangement of various tools within handles 20, 30 of multi-purpose tool 10 may be similar to that of multi-purpose tool 100 of FIGS. 3–20, which will now be described.

Figure 3:
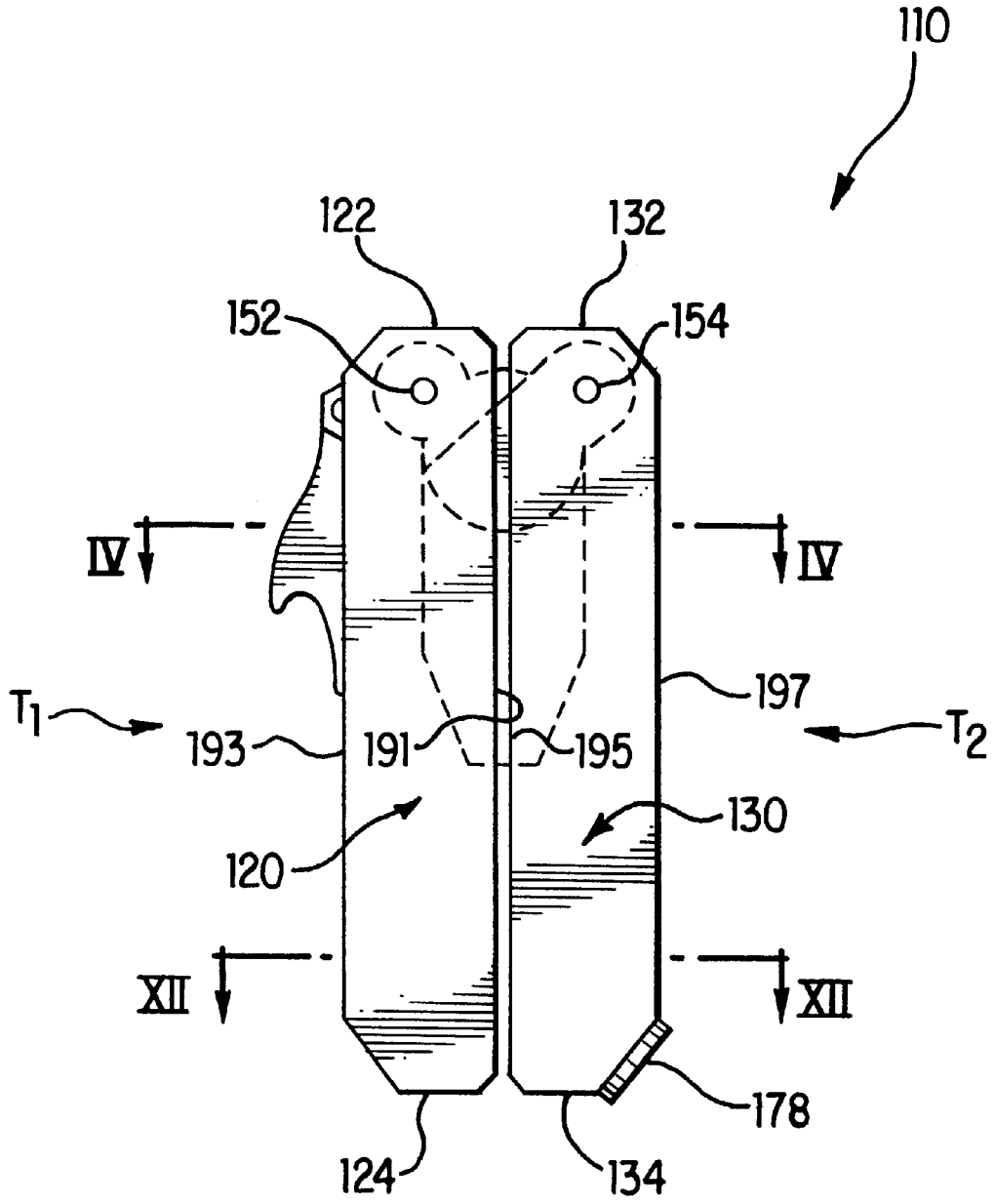
FIG. 3 is a front elevational view of another embodiment of a multi-purpose tool formed in accordance with the principles of the present invention and in a folded position.
Figure 7:
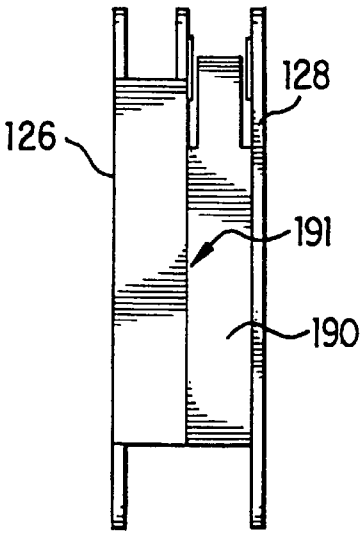
FIGS. 5–7 are left, front, and right side elevational views, respectively, of the S-channel region in the first handle.
Figure 4:
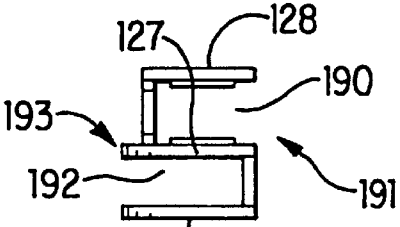
FIG. 4 is a cross-sectional view along line IV—IV of FIG. 3 illustrating the S-channel region of the first handle.
Figure 6:
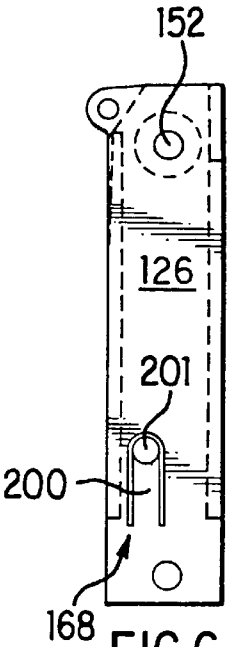
Figure 5:
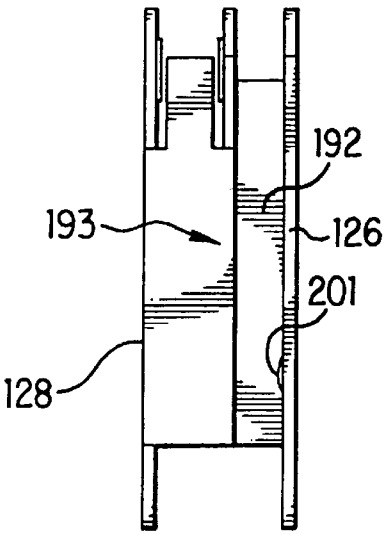

A multi-purpose tool 110, similar to multi-purpose tool 10, is shown in a folded configuration in FIG. 3. It will be appreciated that elements of multi-purpose tool 110 similar to elements of tool 10 have the same reference character increased by 100. Tool 110 has first and second handles 120, 130 to which a variety of tools are pivotably coupled for pivoting between a retracted storage position and an extended working position. Thus, handles 120 and 130 are formed with channels in which tools may be positioned. The storage channels may be formed in any desired manner, such as a side-by-side configuration as shown in FIGS. 4–11. The side-by-side configuration may be appreciated with reference to the cross-sectional view of first handle 120, along line IV—IV of FIG. 3, with the enclosed tools omitted for the sake of clarity, as shown in FIG. 4. First handle 120 has a first channel 190 along first side 191 and a second channel 192 along second side 193. First and second channels 190, 192 are coextensive near top end 122 of first handle 120 and, together with front side 126, back side 128, and common channel wall 127 of first handle 120, impart first handle 120 with an S-shaped cross-section, as illustrated in FIG. 4. Left, front, and right side elevational views of the S-channel region of first handle 120, e.g., the region where the first and second channels 190, 192 are coextensive, are shown in FIGS. 5–7, respectively.

Figure 8:
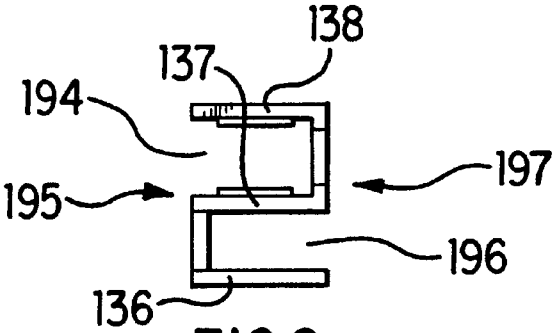
FIG. 8 is a cross-sectional view along line IV—IV of in FIG. 3 illustrating the S-channel region of the second handle.
Figure 10:
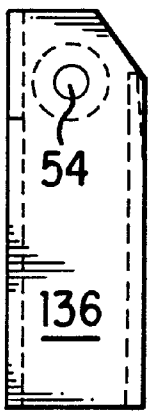
FIGS. 9–11 are left, front, and right side elevational views, respectively, of the S-channel region in the second handle.
Figure 9:
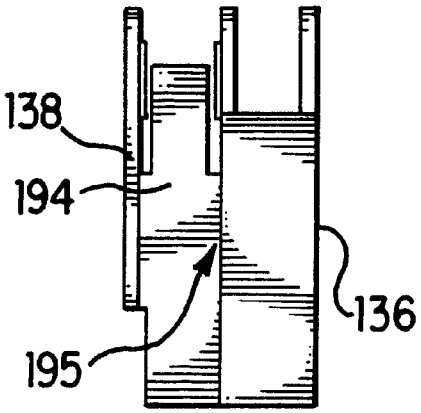
Figure 11:
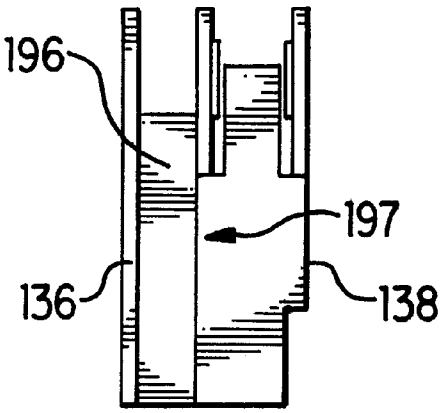

A cross-sectional view of second handle 122, along line IV—IV of FIG. 3, with the enclosed tools omitted for the sake clarity, is shown in FIG. 8. Similar to first handle 120, second handle 122 has a first channel 194 defined in first side 195 and a second channel 196 defined in second side 197. Channels 194, 196 are bounded by front side 136, rear side 138 and common channel wall 137 of second handle 122 to impart second handle 122 with an S-shaped cross-section, as illustrated in FIG. 8. Left, front, and right side elevational views of the S-channel region in second handle 122, e.g., the region where the first and second channels 194, 196 are coextensive, are shown in FIGS. 9–11, respectively.

Figure 13:
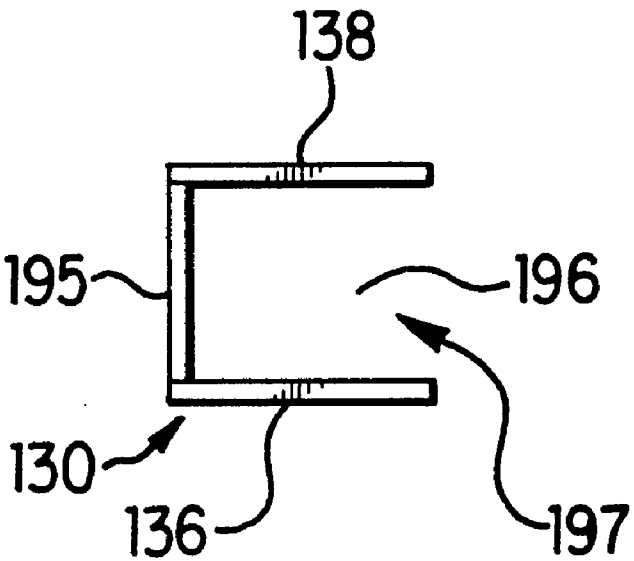
FIG. 13 is a cross-sectional view along lines XII—XII of FIG. 3 of the second handle.
Figure 12:
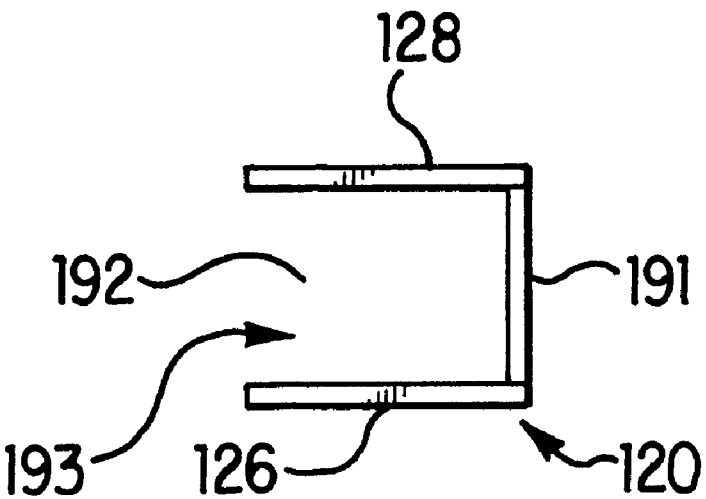
FIG. 12 is a cross-sectional view along line XII—XII of FIG. 3, of the first handle.

Handles 120, 130 may be configured to have an S-shaped configuration along substantially their entire length between respective top ends 122, 132 and bottom ends 124, 134. However, in a preferred embodiment, first channels 190, 194 only extend part way from top end 122, 132 toward bottom ends 124, 134 of handles 120, 130, respectively, up to a predetermined termination point $T_1$, $T_2$. Beyond termination points, only one channel, such as second channels 192, 196, is defined. It will be appreciated that the termination point for channels 190, 192 in first handle 120 need not directly align with the termination point for channels 194, 196 in second handle 130. First and second handles 120, 130 in the "non-coextensive" region between termination point $T_1$, $T_2$ and bottom ends 124, 134 of respective handles 120, 130 preferably have a "U" shaped cross-section as may be appreciated with reference to FIGS. 12 and 13, illustrating cross-sectional views of first and second handles 120, 130, respectively, along line XII—XII of FIG. 3. The enclosed tools are omitted from FIGS. 12 and 13 for the sake of clarity.

When multi-purpose tool 110 is in a folded configuration, such as in FIG. 3, first channels 190, 194 face each other and second channels 192, 196 face away from each other. Thus tools within second channels 192, 196 are accessible. Preferably, a tool head 140 with pivotably coupled jaw members, such as pliers, is stored in first channels 190, 194. Tang 148 of tool head 140 is mounted on pivot axis 152 in first channel 190 of first handle 120 as may be appreciated with reference to FIG. 19, described in further detail below. Similarly, tang 150 is mounted on pivot axis 154 in first channel 194 of second handle 130, as may also be appreciated with reference to FIG. 19. Tool head 140 is therefore mounted so that when the multi-purpose tool 110 is folded into a storage configuration, tool head 140 is nested in first channels 192, 194 and substantially hidden from view, as shown in phantom in FIG. 3.

When first and second handles 120, 130 are pivoted about tang pivot axes 152, 154, to open multi-purpose tool 110, tool head 140 is extended from its retracted position into a usable position, similar to the open configuration of multi-purpose tool 10 as shown in FIG. 2. Sides 191, 195 are thereby exposed to face outwardly, away from each other, and sides 193, 197 are thereby positioned at the inside of multi-purpose the tool 110, facing each other in this configuration for use of tool head 140. It will be appreciated that when multi-purpose tool 110 is opened, channels 192, 196 of handles 120, 130, respectively, face each other. Thus, any tools within channels 192, 196 will be safely covered when multi-purpose tool 110 is open and tool head 140 is in a working position and configuration.

A variety of different pivoting and non-pivoting tools can be arranged within second channels 192, 196 adjacent top ends 122, 132 of handles 120, 130, respectively, or adjacent bottom ends 124, 134 of handles 120, 130, respectively. Referring now to FIGS. 14–20, multi-purpose tool 110 may include such tools as a scraper 160, flashlight 172, and a pressure gauge 174, as well as several tools conventionally provided in multi-purpose tools, such as a blade 184 and screwdriver 186.

Figure 15:
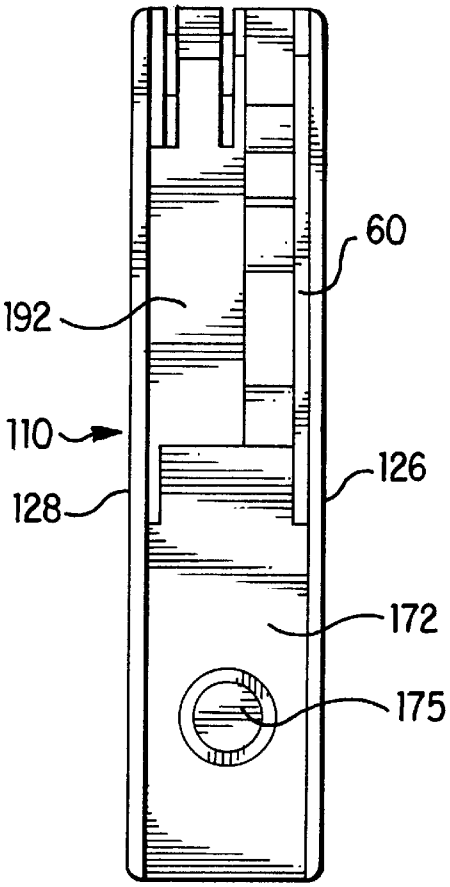
FIG. 15 is a left side elevational view of the tool of FIG. 3.
Figure 14:
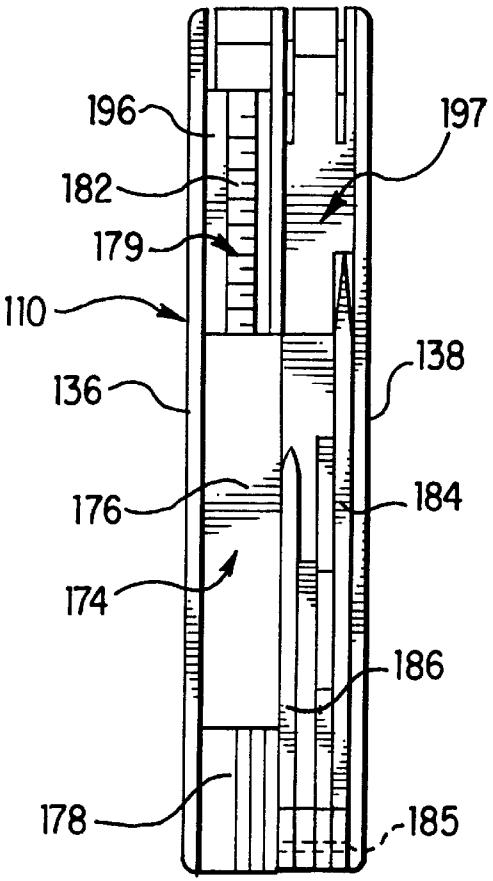
FIG. 14 is a right side elevational view of the tool of FIG. 3.
Figure 16:
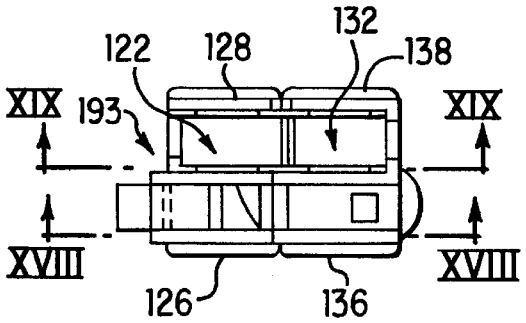
FIG. 16 is a top view of the tool of FIG. 3.
Figure 17:
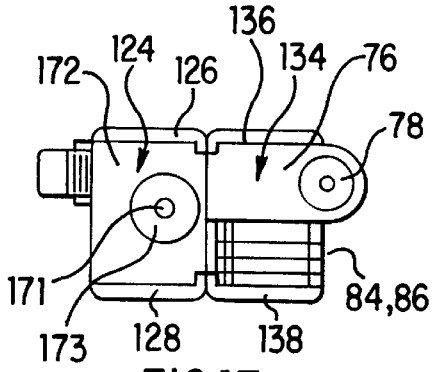
FIG. 17 is a bottom view of the tool of FIG. 3.

The right and left sides of multi-purpose tool 110 are shown respectively in FIGS. 14 and 15, incorporating each of the above-mentioned tools. Top and bottom views of multi-purpose tool 110 are shown in FIGS. 16 and 17, respectively. The position of tools in second channel portions 192, 196 of handles 120, 130, respectively, maybe appreciated with reference to cross-sectional view illustrated in FIG. 18 of multi-purpose tool 110 along line XVIII—XVIII of FIG. 16. The position of tool head 140 stored within first channel portions 190, 194 in the coextensive "S-channel" region (between top ends 122, 132 and termination points $T_1$ and $T_2$) as well as tools in the second channel portions 192, 196 in the non-coextensive region of handles 120, 130 (between termination points $T_1$ and $T_2$ and bottom ends 124, 134) may be appreciated with reference to the cross-sectional view of multi-purpose tool 110 along line XIX—XIX of FIG. 16, as illustrated in FIG. 19.

Figure 18:
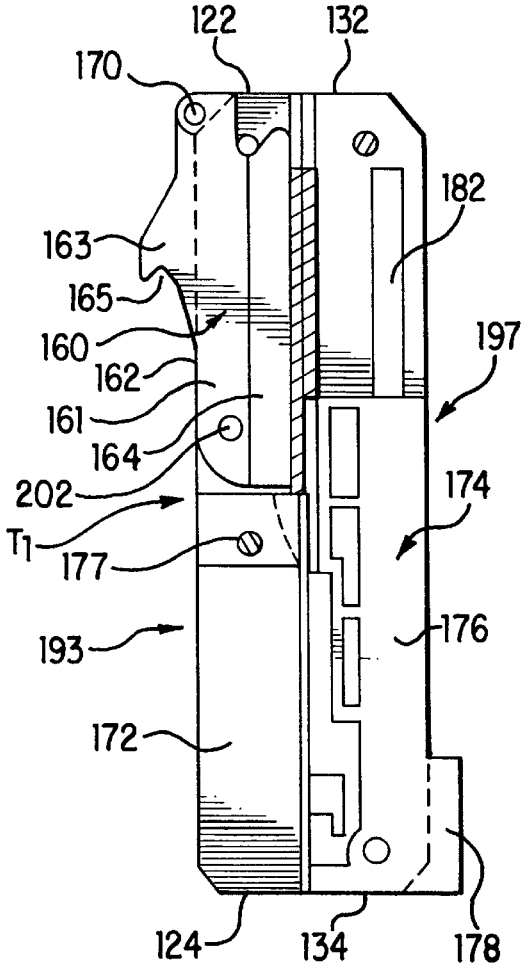
FIG. 18 is a cross-sectional view along line XVIII—XVIII of FIG. 16, showing the tools in the second channel portions of the handles.
Figure 19:
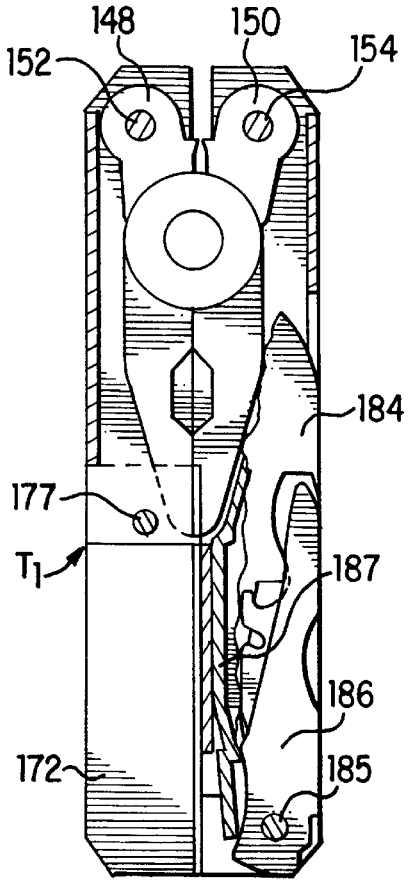
FIG. 19 is a cross-sectional view along line XIX—XIX of FIG. 16, showing the folded tool head and additional tools in the lower portion of the second channels.
Figure 24:
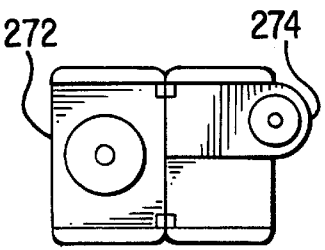
FIG. 24 is a bottom view of the multi-purpose tool of FIG. 21.
Figure 23:
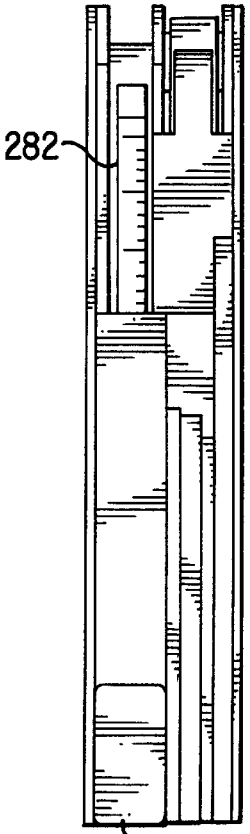
FIG. 23 is a right side elevational view of the multi-purpose tool of FIG. 21.
Figure 21:
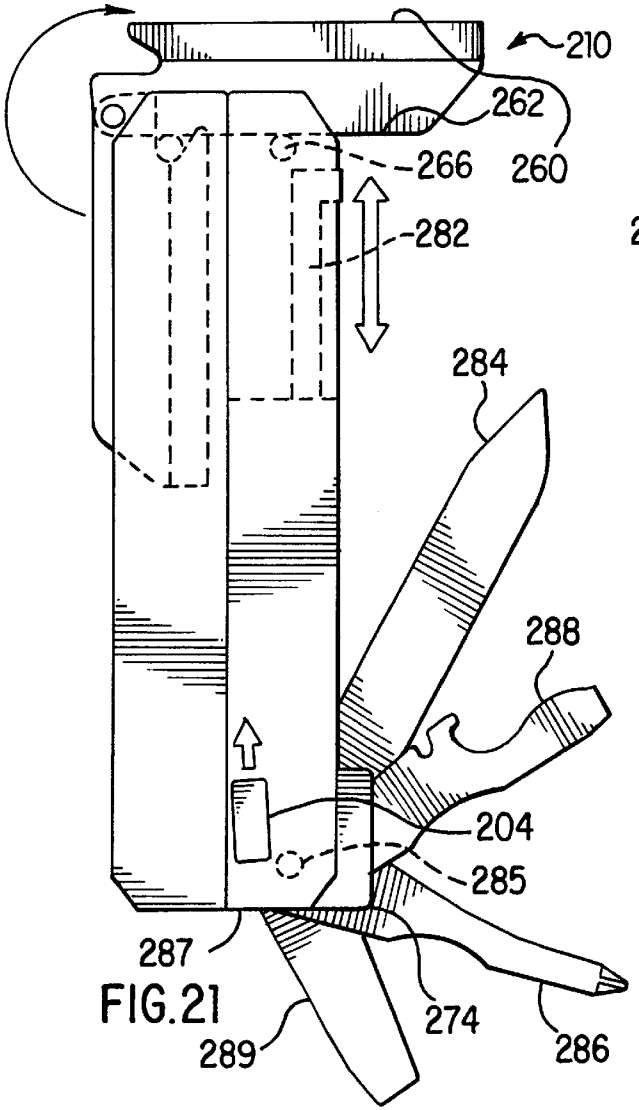
FIG. 21 is a front elevational view of another multi-purpose tool formed in accordance with the principles of the present invention, with several pivotably mounted tools pivoted towards a working position.

As shown in FIG. 18, scraper 160 is preferably mounted at top end 122 of first handle 120, preferably via pivot axis 170, of multi-purpose tool 110, and stored in second channel 192 in first handle 120. Pivot axis 170 is positioned near the corner formed by top end 122 of first handle 120 and second side 193. Placing pivot axis 170 near the corner permits scraper 160 to pivot to a working position in excess of 180° and preferably up to 270°, as discussed above. A variety of different blade composition for scraper 160 may be used. For example, scraper 160 may have a steel body 161 with a plastic scraping blade 164 fitted thereto. Alternatively, scraper 160 may be formed in its entirety from a material with sufficient strength for the desired scraping function, such as glass-filled nylon.

Figure 20:
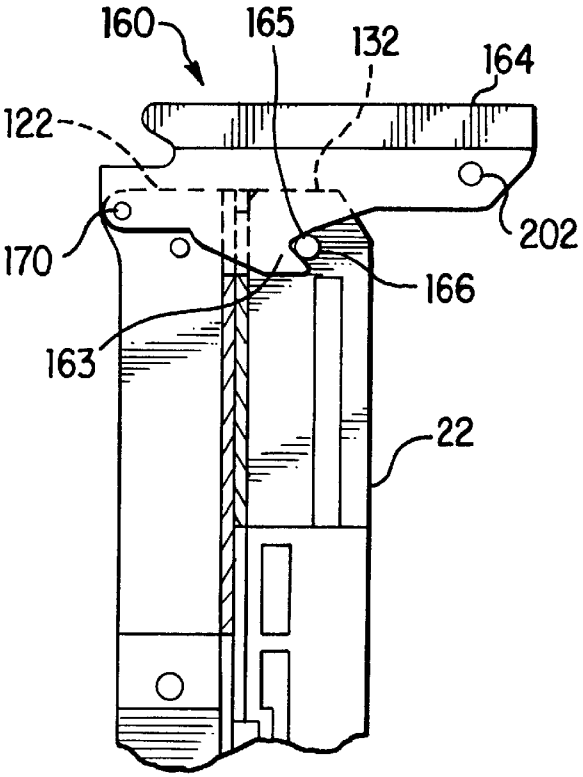
FIG. 20 is a partial front elevational view of the multi-purpose tool of FIG. 3 with the scraper locked in a working position.

In addition, scraper 160 preferably has a finger portion 163 that extends outwardly from access edge 162. Finger portion 163 facilitates grasping of scraper 160 for deployment. In addition, as shown in FIG. 20, when scraper 160 is in a working position, finger portion 163 extends into second channel 196 in second handle 130 top end 132. A locking mechanism 166 preferably is provided within the top portion of second channel 196 to interact with finger portion 163 to lock scraper 160 in the working position shown in FIG. 20. Locking mechanism 166 may be in any desired form, such as a spring, a magnetic clasp or a frictional interface. As shown in FIG. 20, locking mechanism 163 may be a locking pin located in second channel 196 of second handle 130 to engage notch 165 in finger portion 163 when scraper 160 is in the working position shown in FIG. 20 and handles 120, 120 are held together. Most preferably, such a locking pin is coextensive with tang pivot axis 152.

A retention mechanism 168 may also be provided to retain scraper 160 in its storage position when not in use. Preferably, retention mechanism 168 is in the form of a flexible retention finger 200 formed along front side 126 of first handle 120, as shown in FIG. 6, or along common channel wall 127. Retention finger 200 has an extension or protrusion 201, such as a solder bead or a rivet, extending into second channel 192, as shown in FIG. 5. A corresponding hole or depression 202 is formed in scraper 160 and positioned so that extension 201 will engage hole 202 when scraper 160 is in a storage position. Scraper 160 must be pulled with sufficient force to flex retention finger 200 and force extension 201 out of hole 202 in order to withdraw scraper 160 from channel 192.

A flashlight 172 is provided in channel 192 of multi-purpose tool 110, as shown in FIGS. 18 and 19. In a preferred embodiment, flashlight 172 encompasses the entire second channel 192 of first handle 120 below the termination point $T_1$, as may be appreciated with reference to FIGS. 15, 18 and 19. This configuration provides sufficient width for flashlight 172 to use batteries which provide sufficient power to provide a useful degree of illumination, such as size AA or N-type batteries. Flashlight 172 preferably includes conventional elements such as a bulb 171 and a reflector 173 as shown in FIG. 17, and a switch 175, as shown in FIG. 15. Flashlight 172 may be pivotably mounted to handle 120, such as about a substantially centrally located pivot axis 177, as shown in FIGS. 18 and 19, or may be fixedly positioned within channel 192.

Preferably, multi-purpose tool 110 also includes a pressure gauge 174. Pressure gauge 174 includes body portion 176 and valve attachment 178, as discussed above with reference to pressure gauge 74 of multi-purpose tool 10. Pressure gauge 174 is housed in the lower portion of second channel 196 in second handle 130, as shown in FIG. 18. Pressure gauge 174 may be a mechanical gauge with a sliding gauge portion 182 extending past termination point $T_i$, and into the portion of second channel 196 coextensive with first channel 194. A pressure scale 179 may be inscribed along sliding gauge portion 182, or on handle 130 near sliding gauge portion 182, for indicating the measured pressure. Alternatively, a battery operated pressure gauge may be provided with a digital (or analog) readout.

Preferably, pressure gauge 176 occupies only a portion of second channel 196 below termination point $T_2$ of first channel 194, as may be appreciated with reference to FIG. 14. The remaining area in second channel 196 preferably houses additional pivoting tools, such as blade 184 and screwdriver 186 (flat head, as shown, or Phillips head), preferably sharing a common pivot axis 185, as shown in FIGS. 14 and 19. Other tools, such as various blades, scissors, cap lifters, etc. may also be provided. The pivotably mounted tools are preferably maintained in a working and/or storage position using a spring mechanism 187, as will be readily understood by those skilled in the art. If desired, a locking mechanism configured to lock a desired tool into a desired position, such as a working position, may also be provided.

Yet another embodiment of a multi-purpose tool 210 formed in accordance with the principles of the invention is shown in FIGS. 21–25. It will be appreciated that elements of multi-purpose tool 210 similar to elements of multi-purpose tool 110 described above have the same reference character increased by 100.

Figure 22:
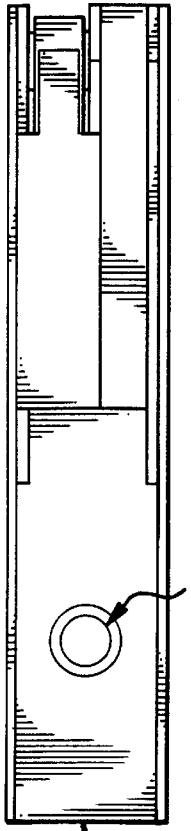
FIG. 22 is a left side elevational view of the multi-purpose tool of FIG. 21.

Multi-purpose tool 210 includes a scraper 260 similar to scraper 160 described above but without a finger portion 163. As shown in FIG. 22 when scraper 260 is in a working position, access edge 262 preferably engages a blocking mechanism 266, such as a pin, to prevent scraper 260 from rotating beyond substantially 270° from its storage position.

Multi-purpose tool 210 preferably includes a variety of pivotably mounted tools. As shown in FIGS. 21–24, the pivotably mounted tools include a blade 284 (optionally serrated, as shown), a screwdriver 286 (Phillips head, as shown, or flat head), a cap lifter 288, and a crate opener 289. The tools are preferably maintained in a working and/or storage position using a spring mechanism 287, as will be readily understood those skilled in the art. If desired, a locking mechanism having a sliding lock release switch 204, as described in U.S. patent application Ser. No. 08/874,959, filed Jun. 13, 1997, now U.S. Pat. No. 6,009,582 which application is hereby incorporated by reference herein in its entirety.

Figure 25:
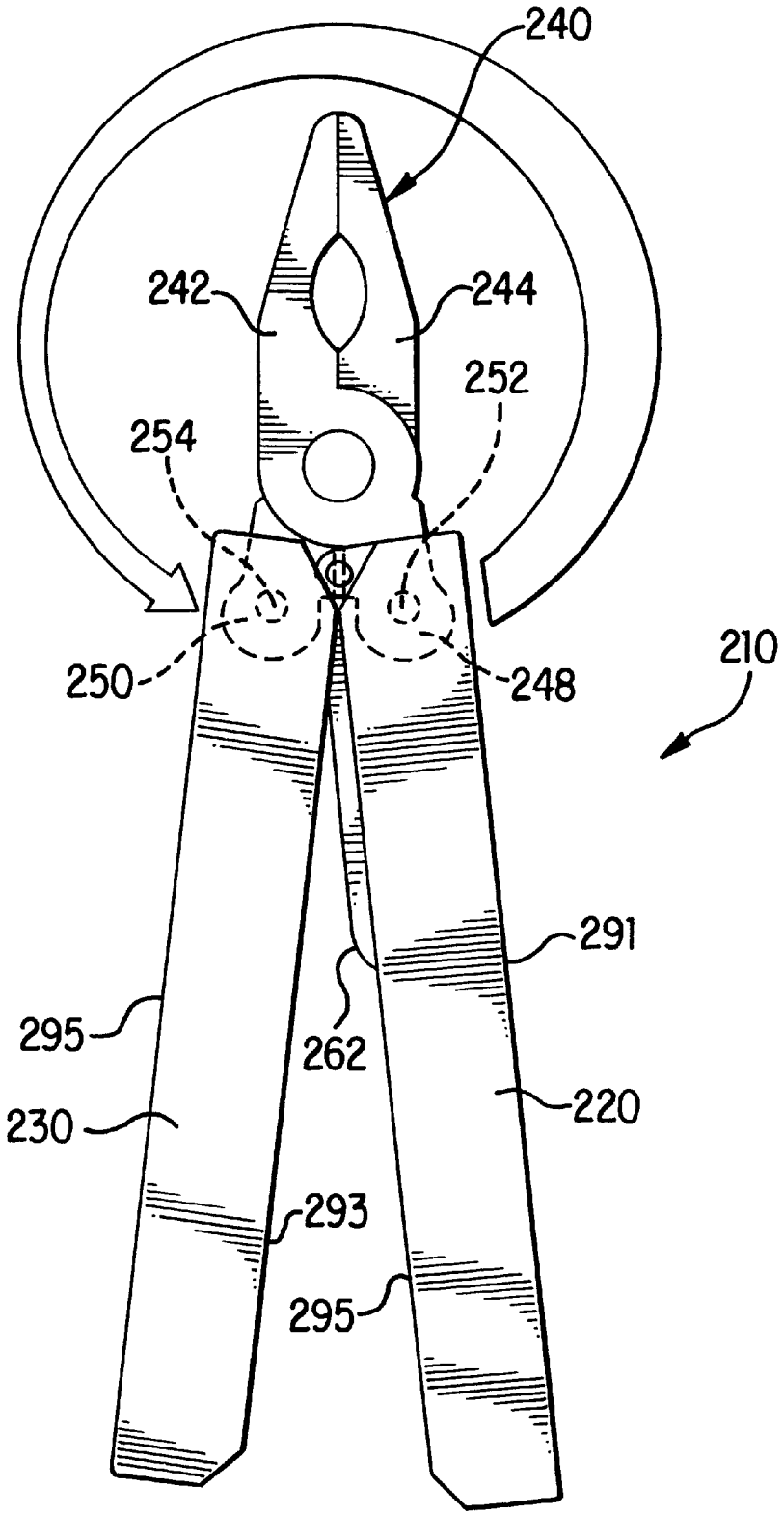
FIG. 25 is a front elevational view of the multi-purpose tool of FIG. 21 in an unfolded position.

As shown in FIG. 25 and as discussed above with respect to multi-purpose tools 10 and 110, handles 220 and 230 are pivotably mounted at tang pivot axes 252, 254 such that the multi-purpose tool 210 may be unfolded to expose tool head 240 for use. Also shown in FIG. 25, access edge 262 of scraper 260 may protrude somewhat from side 295 of handle 220.

It will be appreciated that the tools coupled to the multi-purpose tools described thus far may be modified in a variety of manners without departing from the scope and principles of the present invention. Variations may include changes to the materials or sizes of individual tools described above. For example, the scraper may be formed from the same material, selected to provide the strength required for applying scraping forces, such as glass-filled nylon. If desired, the size and configuration of the flashlight may be altered to provide a larger reflector. Changes to the configuration of the tools, themselves, may be made as well. For example, the pressure gauge may be formed as a digital pressure gauge, and the handles need not have the S-shaped cross-section described above. Moreover, the manner in which the tools are coupled to the multi-purpose tool housing may be varied as desired. For instance, the pressure gauge may be pivotably mounted, instead of in a fixed position as described above, whereas the flashlight may be fixedly mounted without the pivotability described above. It will be appreciated that the scraper tool need not be mounted as described above, but may instead be mounted in any desired manner. Most preferably the scraper tool is mounted such that its scraping edge is substantially perpendicular to the longitudinal axes of the multi-purpose tool handles to impart the greatest amount of force to the scraping edge in the most efficient manner, as described above.

Figure 26:
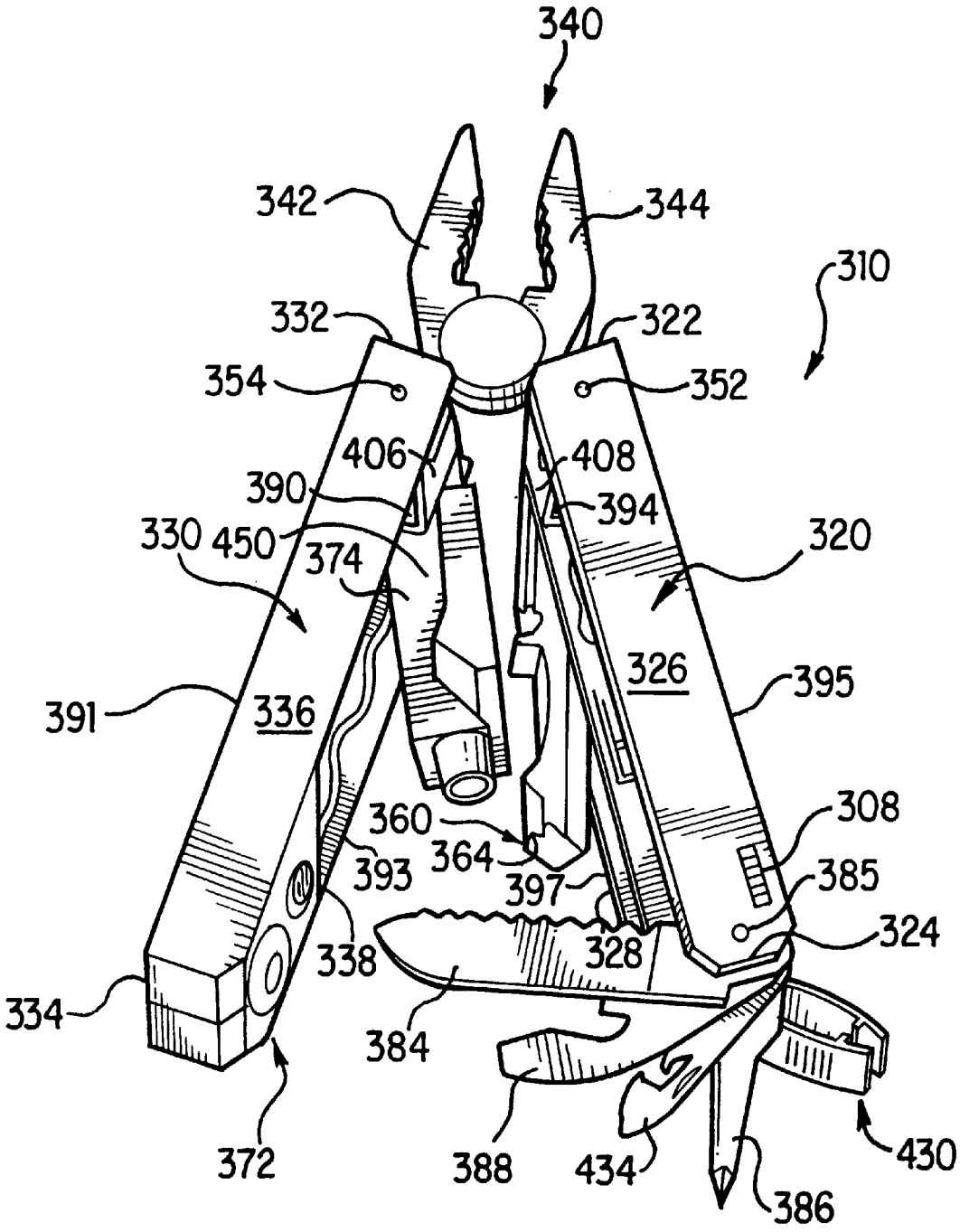
FIG. 26 is a perspective view of another multi-purpose tool formed in accordance with the principles of the present invention, with several pivotably mounted tools pivoted towards a working position.
Figure 27:
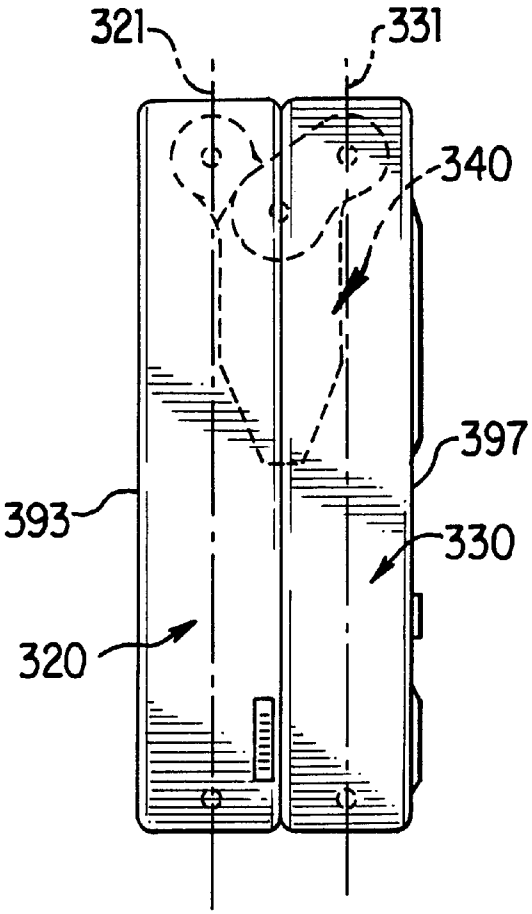
FIG. 27 is a front elevational view of the multi-purpose tool of FIG. 26 in a folded configuration.

The above and other modifications may be understood with reference to multi-purpose tool 310 of FIGS. 26–32. As may be appreciated with reference to FIG. 26, like above-described multi-purpose tools 10, 110, and 210, multi-purpose tool 310 has first and second handles 320, 330 to which a tool head 340 with jaw members 342, 344 are pivotably coupled and to which a variety of additional tools are coupled. It will be appreciated that elements of multi-purpose tool 310 which are similar to elements of multi-purpose tool 110 are referenced with the same reference characters increased by 200. As with the above-described multi-purpose tools, handles 320, 330 of multi-purpose tool 310 may be reoriented from the position shown in FIG. 26 to place multi-purpose tool 310 into a folded configuration as shown in FIG. 27.

Multi-purpose tool 310 includes first channels 390, 394, partially defined by U-channels 406, 408 (FIG. 26), along first sides 391, 395. When multi-purpose tool 310 is reoriented into the folded configuration of FIG. 27, jaws 342, 344 are moved into first channels 390, 394 for storage, as may be appreciated with reference to the phantom illustration of tool head 340 in FIG. 27. Tool head 340 is similar to the above-described tool heads 40, 140, and 240, and therefore will not again be described in further detail, reference being made to the above descriptions of similar tool heads and corresponding coupling to the handles of a multi-purpose tool.

Figure 29:
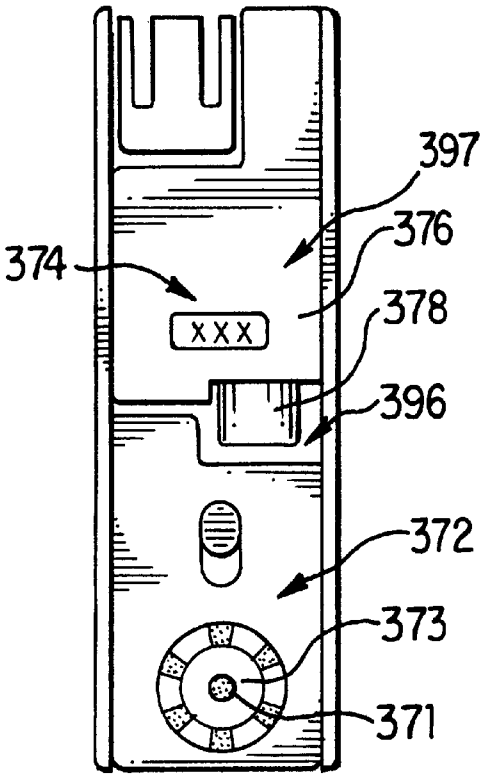
FIG. 29 is a right side elevational view of the multi-purpose tool of FIG. 27.
Figure 28:
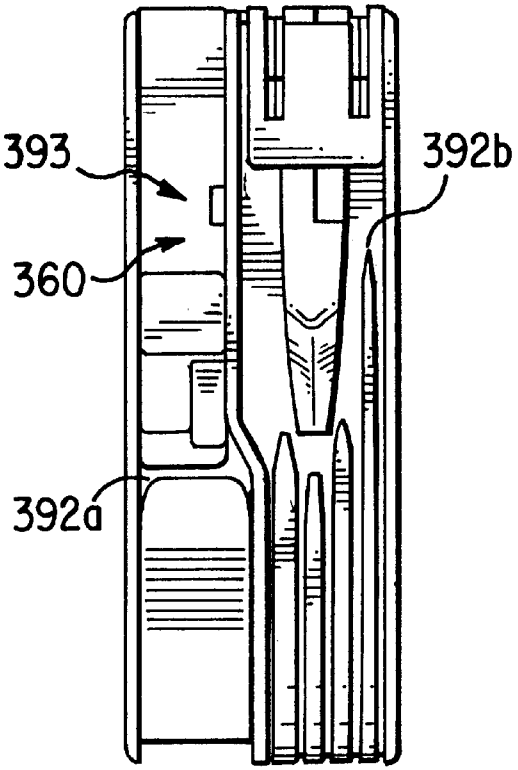
FIG. 28 is a left side elevational view of the multi-purpose tool of FIG. 27.

Multi-purpose tool 310 also includes second channels 392, 396 along second sides 393, 397 of handles 320, 330, respectively, in which a variety of tools may be positioned, as shown in FIGS. 28 and 29. If such tools are pivotably coupled to handles 320, 330, then such pivotable tools may be extracted from second channels 392, 396 into a working position and later retracted into second channels 392, 396 for storage. It will be appreciated that second channels 392, 396 are readily accessible when multi-purpose tool 310 is in the folded configuration of FIG. 27 but are not readily accessible when multi-purpose tool 310 is in the position shown in FIG. 26. Accordingly, such tools generally are not intended to be extracted when multi-purpose tool 310 is in the position shown in FIG. 26, extraction of the pivotably mounted tools being shown in FIG. 26 simply for the sake of illustration.

Figure 30:
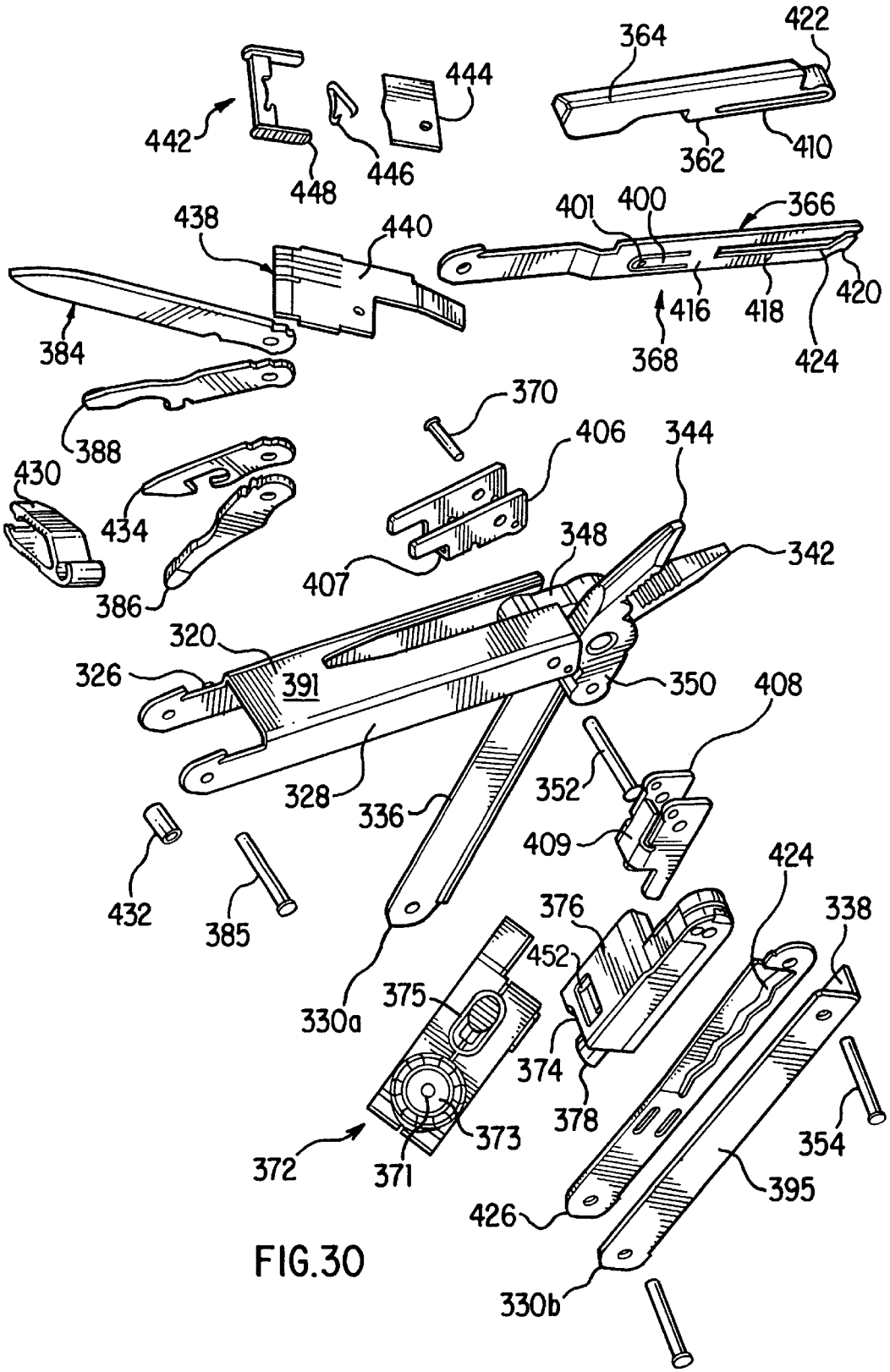
FIG. 30 is an exploded view of the multi-purpose tool of FIG. 26.

Reference will now be made to the exploded view of FIG. 30 for further discussion of the tools coupled to multi-purpose tool 310 as well as the overall configuration and orientation of the elements forming multi-purpose tool 310. First and second handles 320, 330 may be formed in any desired manner. As shown in FIG. 30, first handle 320 may be formed from a single piece, such as a metal plate, formed (e.g., bent) into a U-shape to form a side wall 391, a front wall 326, and a rear wall 328. Second handle 330 may be formed from a single piece as well. However, in the embodiment illustrated in FIG. 30, second handle 330 is formed from first and second pieces 330*a*, 330*b* coupled together to form a U-shaped handle 330. As shown, first handle piece 330*a* forms front wall 336 of handle 330 and second handle piece 330*b* is an L-shaped piece forming rear wall 338 and side wall 395. It will be appreciated that first handle 320 may similarly be formed from more than one piece, and that the pieces forming either handle may include greater than two pieces or may have configurations other than the illustrated configurations. Preferably, a U-shaped channel 406 is positioned between front and rear side walls 326, 328 of second handle 320 such that the base 407 forms a portion of second side 393 of first handle 320. Similarly, a U-shaped channel 408 is positioned between front and rear side walls 336, 338 of second handle 320 such that the base 409 forms a portion of second side 397 of second handle 330.

Jaw member 342 is pivotably coupled to first handle 320 via pivot pin 352 and jaw member 344 is pivotably coupled to second handle 330 via pivot pin 354. Upon pivoting jaw member 342 about pivot pin 352 into the storage position of FIG. 27, at least tang 348 of jaw member 342 may be stored within U-shaped channel 406. Likewise, upon pivoting jaw member 344 about pivot pin 354 into the storage position, at least tang 350 of jaw member 344 may be stored within U-shaped channel 408. Preferably, jaw members 342, 344 function not only as pliers but also include surfaces useful for wire cutting, electrical crimping, wire stripping, and wire bending.

A variety of additional tools, preferably tools useful to have available in an automobile, may be coupled to handles 320, 330 of multi-purpose tool 310, as may be appreciated with reference to FIGS. 26 and 30. Such tools may either be fixedly coupled to one of handles 320, 330 or pivotably mounted about a pivot axis.

Figure 31:
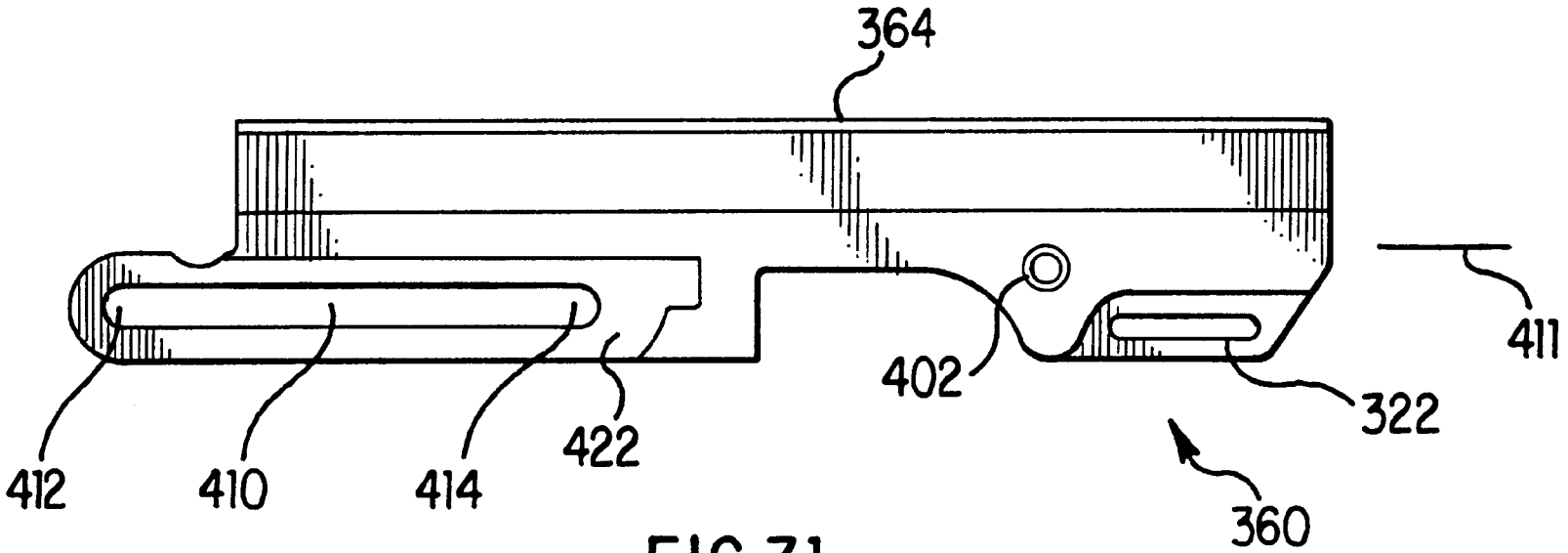
FIG. 31 is a front elevational view of the scraper of the multi-purpose tool of FIG. 26.

As in the previously described multi-purpose tools, multi-purpose tool 310 preferably includes a scraper 360 which preferably is formed from a single piece of material, sufficiently strong for application of the desired scraping forces, formed into the desired shape. As may be appreciated with reference to FIGS. 26 and 30, scraper 360 is pivotably coupled to first handle 320 via pivot 370. However, multi-purpose tool 310 may be configured such that scraper 360 is coupled to second handle 330 instead. A scraper retention mechanism 368 preferably is provided to retain scraper 360 in a storage position within handle 320. Scraper retention mechanism 368 may be in any desired configuration, such as a retention finger 400 with an extension or protrusion 401 shaped to fit into a corresponding hole or depression 402 in scraper 360, as shown in FIG. 31. Release of such retention mechanism 368 is accomplished by pulling on access edge 362 of scraper 360 with sufficient force to overcome the friction fit between protrusion 401 and hole 402.

Preferably, scraper 360 is configured to be extracted from its storage position within channel 392 and pivoted approximately 270° into a working position substantially perpendicular to longitudinal axes 321, 331 of handles 320, 330, respectively. As may be appreciated with reference to FIG. 31, scraper 360 preferably includes a slot 410 by which scraper 360 is pivotably coupled to handle 320. Once scraper 360 is withdrawn and pivoted approximately 180° from its storage position, scraper 360 is moved along its longitudinal axis 411 so that pivot 370 slides from first end 412 of slot 410 to second end 414 of slot 410. Scraper 360 is ready to be further pivoted about pivot 370 until scraper 360 is substantially perpendicular to longitudinal axes 321, 331 of handles 320, 330, respectively, in a working position.

Preferably, a locking mechanism 366 is provided to lock scraper 360 into the working position. As may be appreciated with reference to FIG. 30, locking mechanism 366 of multi-purpose 310 may be in the form of a scraper line lock spring 416 having a locking finger 418 extending away from the plane of the line lock spring body 417 and locking finger extension 420. Upon mounting to handle 320, scraper 360 and scraper lock spring 416 are positioned such that locking finger 418 will engage access edge 362 and locking finger extension 420 will insert into scraper notch 422 (FIG. 31) when scraper 360 is in the working position, thereby locking scraper 360 into the working position. It will be appreciated that the relative positions of scraper 360 and scraper line lock spring 416 shown in FIG. 30 are reversed upon mounting, such that scraper 360 is positioned on the side on which locking finger 418 extends beyond the remaining portions of scraper line lock spring 416.

Above-described scraper retention mechanism 368 is preferably formed in scraper line lock spring 416. It will further be appreciated with reference to FIG. 28 that scraper line lock spring 416 forms a separating wall in storage channel 392, dividing channel 392 into a first channel section 392*a* and a second channel section 392*b*. The tools stored in first and second channel sections 392*a* and 392*b* may be divided, for example, based on the material (e.g., metal or a synthetic) from which the tool is formed.

Scraper line lock spring 416 may be in the form of a conventional line lock spring which substantially aligns with the tool to be locked, as will be understood by those of ordinary skill in the art. In accordance with a preferred embodiment, locking finger 418 is formed by providing a serpentine cut 424 along scraper line lock spring 416, such as shown with reference to pressure gauge line lock spring 426 described below. Serpentine cut 424 has been found to provide a configuration for line lock springs, generally, which prevents the line lock springs from interlocking with each other, such as when transported or further processed (e.g., polished) in bulk.

As will be appreciated, movement of scraper locking finger 418 into alignment with the remainder of scraper line lock spring 416 will disengage locking finger 418 from notch 422 of scraper 360 and from against access edge 362 to permit pivoting of scraper 360 back to the storage position. It will be appreciated that other manners of extracting scraper 360 from its storage position and reorienting scraper 360 into its working position are within the scope of the present invention.

An additional tool may be provided in channel section 392*a* with scraper 360. As shown in FIGS. 26 and 28, a fuse puller 430 may be pivotably coupled to bottom end 324 of handle 320 for storage within channel section 392*a*. Fuse puller 430 preferably is a conventional fuse puller formed from an insulating, non-conductive material and may be removably coupled to handle 320 via pivot 385. If desired, fuse puller 430 may be mounted to pivot 385 via a bushing 432.

A variety of pivotably mounted tools, preferably tools which are convenient to have available in an automobile, may be provided in channel section 392*b*. For example, as shown in FIGS. 26 and 30, pivotably mounted tools may include a blade 384 (serrated or straight), a cap lifter 388, a screwdriver 386 (Phillips head or flathead), and a can opener 434. It will be appreciated that a free end of either or both blade 384 and cap lifter 388 (or any additional tool) may shaped to function as flathead screwdrivers.

The pivotably mounted tools preferably are maintained in a working and/or storage position using a spring mechanism 387, as will be readily understood those skilled in the art. In a preferred embodiment, spring mechanism 387 is in the form of a plurality of leaf springs 438, preferably formed from a common leaf spring plate 440, such that each pivotably mounted tool may be engaged by a separate leaf spring 438, as may be appreciated with reference to FIG. 30. Additionally, a locking mechanism 442 may be provided to lock each tool in its working position such that the tool does not accidentally retract into the storage position during use. As shown in FIG. 30, locking mechanism 442 may be in the form of a sliding lock release switch having a locking plate 444 biased by a spring 446 into engagement with a notch in one of the pivotably mounted tools to prevent retraction of the tool into the storage position. An actuator 448 preferably is provided to move locking plate 444 away from the locked tool to permit retraction of the tool when desired. Such a locking mechanism is described in above-incorporated copending U.S. patent application Ser. No. 08/874,959.

A flashlight 372 preferably is provided in second handle 330. Flashlight 372 preferably includes conventional elements such as a bulb 371, a reflector 373, and a switch 375, as shown in FIG. 29. Flashlight 372 is fixedly positioned within channel 396 with bulb 371 positioned to shine light outwardly from side 397 of multi-purpose tool 310 rather than from an end thereof, as common in commercially available pocket knifes. Preferably, flashlight 372 is configured to accept a standard replaceable battery, such as an N-type battery or size AA or AAA battery, providing sufficient power to provide the desired degree of illumination for potential uses of multi-purpose tool 310.

A pressure gauge 374 preferably is also provided in second handle 330. Pressure gauge 374 includes body portion 376 which is preferably pivotably mounted to second handle 330 to extract valve attachment 378 from channel 396 and into a convenient use position. The inwardly positioned face 450 of pressure gauge 374 may be shaped to provide a receiving channel for jaw member 342 upon folding multi-purpose tool 310 into the folded configuration of FIG. 27. Preferably, pressure gauge 374 is a battery powered pressure gauge powered by a long-lasting battery, such as a lithium battery. The battery preferably should at least last for ten years providing at least fifty operational cycles per month. A preferably digital display 452 is provided to indicate the measured pressure. It will be appreciated that other types of displays, such as analog displays, and/or other types of pressure gauges may be used instead of the pressure gauge shown in the figures.

While a multi-purpose tool formed in accordance with the principles of the present invention is particularly shown and described herein with reference to particular embodiments, it is to be understood that the invention may be used with many additions, substitutions, or modifications of form, structure, arrangement, proportions, materials, and components and otherwise, used in the practice of the invention, which are particularly adapted to specific environments and operative requirements without departing from the spirit and scope of the present invention. For instance, various other tools or other implements, such as an Allen wrench, a compass, or a clock device, may be provided. Moreover, although certain of the tools coupled to the above-described multi-purpose tools are shown protruding somewhat from the multi-purpose tool, it will be appreciated that such tools may instead be flush with the sides of multi-purpose tool. Conversely, other tools which are shown as being flush with the multi-purpose tool may somewhat protrude therefrom, instead. The presently disclosed embodiments are therefore to be considered in all respects as illustrative and not restrictive, the scope of the invention being indicated by the appended claims, and not limited to the foregoing description.

What is claimed is:

1. A multi-purpose tool comprising:

at least one handle;

a jawed tool having first and second jaws pivotably coupled together; and a plurality of additional tools coupled to said at least one handle, at least one of said tools selected from the group consisting of: a pressure gauge pivotably coupled to said at least one handle and a fuse puller.

2. The multi-purpose tool of claim 1, wherein:

said at least one handle comprises first and second handles;

said first handle includes first and second channels having access openings facing in opposite directions; and said second handle includes first and second channels having access openings facing in opposite directions.

3. The multi-purpose tool of claim 2, wherein:

said first jaw is pivotably coupled to said first handle for positioning between a storage position in said first channel of said first handle and a working position in which said first handle is positioned to impart force to said first jaw; and said second jaw is pivotably coupled to said second handle for positioning between a storage position in said first channel of said second handle and a working position in which said second handle is positioned to impart force to said second jaw;

whereby when said first and second jaws are in said working position, said first and second handles extend therefrom as handles of said jawed tool.

4. The multi-purpose tool of claim 3, wherein:

said additional tools are positioned in at least one of said second channels of said first and second channels;

said first and second handles are pivotably coupled together for positioning said multi-purpose tool between a closed configuration in which said second channels face in opposite directions and said additional tools mounted therein are accessible and an open configuration in which said jaw members are in said working position and said second channels face each other.

5. The multi-purpose tool of claim 2, wherein:

said first and second handles each have a longitudinal axis;

said additional tools comprise a scraper having an access edge and a scraping edge; and said scraper is pivotably coupled to one of said handles to permit pivotable movement between a storage position in said second channel of one of said first and second handles with said access edge being accessible and a working position substantially perpendicular to said longitudinal axes of said first and second handles with said scraping edge substantially perpendicular to and facing away from at least said first handle.

6. The multi-purpose tool of claim 1, further comprising a flashlight.

7. The multi-purpose tool of claim 1, wherein said additional tools include a digital pressure gauge.

8. A multi-purpose tool comprising:

a first handle having a longitudinal axis, a first channel defined in a first side, and a channel base at a second side;

a second handle coupled to said first handle and having a longitudinal axis; and a scraper having a longitudinal axis, an access edge along said longitudinal axis, and a scraping edge opposite said access edge and along said longitudinal axis;

wherein said scraper is pivotably coupled to said first handle for pivoting between a storage position within said first channel of said first handle with said access edge being adjacent said first side and accessible through said first channel, and with said scraping edge facing into said first channel and being adjacent said channel base, and a working position in which said scraper longitudinal axis is substantially perpendicular to at least said first handle longitudinal axis, with said scraping edge facing away from said handle;

and wherein in a folded configuration of said multi-purpose tool said first channel of said first handle faces outwardly away from said second handle such that said access edge of said scraper is accessible when said scraper is in said storage position and said multi-purpose tool is in said folded configuration.

9. The multi-purpose tool of claim 8, further comprising a locking mechanism positioned to maintain said scraper in said working position.

10. The multi-purpose tool of claim 9, wherein:

said scraper is pivotably coupled to said first handle at a pivot end of said scraper; and said locking mechanism comprises a line lock spring including a locking finger biased into abutment with said pivot end of said scraper to prevent retraction of said scraper into said storage position when said scraper is in said working position.

11. The multi-purpose tool of claim 10, wherein:

said line lock spring is biased to abut said scraper access edge when said scraper is in said working position to lock said scraper into said working position;

a notch is defined along said scraper access edge; and said line lock spring further includes a locking finger extension positioned to extend into said notch to lock said scraper into said working position.

12. The multi-purpose tool of claim 8, further comprising a retention mechanism positioned to engage said scraper to maintain said scraper in said storage position.

13. The multi-purpose tool of claim 12, wherein:

said retention mechanism comprises a retention finger having a protrusion extending therefrom toward said scraper; and said scraper has a recessed area shaped to receive said retention mechanism protrusion.

14. The multi-purpose tool of claim 8, wherein:

a slot is defined in said scraper extending along said scraper longitudinal axis between said access edge and said scraping edge; and said scraper is pivotably coupled to said first handle via a pivot extending through said slot to permit both longitudinal and pivotable movement of said scraper with respect to said first handle to move said scraper between said storage position and said working position.

15. The multi-purpose tool of claim 8, wherein:

said first and second handles include top ends and bottom ends;

said scraper is coupled to said first handle adjacent said top end; and said second handle further comprises a locking mechanism at said top end and positioned to engage said access edge and maintain said scraping tool in said working position substantially perpendicular to said handle longitudinal axes.

16. The multi-purpose tool of claim 15, wherein:

said access edge has an outwardly extending finger portion with a notch; and said locking mechanism is positioned to engage said notch when said scraper is pivoted into said working position to maintain said scraper in said working position.

17. The multi-purpose tool of claim 8, wherein:

said first handle further comprises a second channel defined in a second side opposite said first side; and said second handle includes a first channel defined in a first side and second channel defined in a second side opposite said first side.

18. The multi-purpose tool of claim 17, further comprising additional tools coupled to at least one of said first and second handles for moving between a storage position in said second channel and a working position outside of said second channel.

19. The multi-purpose tool of claim 18, further comprising at least one additional tool pivotably coupled to at least one of said first and second handles.

20. The multi-purpose tool of claim 19, wherein:

a plurality of said additional tools are pivotably coupled to one of said first and second handles; and a separate spring mechanism is provided for each of said pivotably coupled additional tools to individually maintain each said pivotably coupled additional tool in said second channel when said tool is in a storage position and in said working position when said tool is in said working position.

21. The multi-purpose tool of claim 19, wherein a locking mechanism is provided to impede said pivotably coupled at least one additional tool from accidentally retracting from said working position into said storage position.

22. The multi-purpose tool of claim 18, wherein said at least one additional tool includes a pressure gauge.

23. The multi-purpose tool of claim 22, wherein said pressure gauge is a digital pressure gauge pivotably coupled to said one of said first and second handles.

24. The multi-purpose tool of claim 18, wherein said at least one additional tool includes a flashlight.

25. The multi-purpose tool of claim 18, wherein said at least one additional tool includes a fuse puller.

26. The multi-purpose tool of claim 25, wherein said fuse puller is coupled to said multi-purpose tool for selective repeated coupling and decoupling to and from said multi-purpose tool.

27. The multi-purpose tool of claim 17, wherein a first channel is defined in said second handle, said multi-purpose tool further comprising:

a first jaw pivotably coupled to said first handle for positioning between a storage position in said first channel of said first handle and a working position in which said first handle is positioned to impart force to said first jaw; and a second jaw pivotably coupled to said second handle for positioning between a storage position in said first channel of said second handle and a working position in which said second handle is positioned to impart force to said second jaw;

whereby when said first and second jaws are in said working positions, said first and second handles extend therefrom as handles of said jawed tool.

28. The multi-purpose tool of claim 1, wherein at least one of said plurality of additional tools is pivotably coupled to said at least one handle.

29. The multi-purpose tool of claim 1, wherein:

a storage channel is defined in said handle; and said pressure gauge is pivotably coupled for movement between a storage position in said storage channel and a working position outside said storage channel.

30. The multi-purpose tool of claim 8, wherein in a folded configuration of said multi-purpose tool, said longitudinal axis of said first handle and said longitudinal axis of said second handle are substantially parallel.

* * * * *